US010104962B2

(12) United States Patent
Booth et al.

(10) Patent No.: US 10,104,962 B2
(45) **Date of Patent: *Oct. 23, 2018**

(54) SELF-RIMMING APRON-FRONT SINK

(71) Applicant: Kohler Co., Kohler, WI (US)

(72) Inventors: Shawn J. Booth, Sheboygan, WI (US); Jason R. Miller, Sheboygan Falls, WI (US); James S. Giefer, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 33 days.

This patent is subject to a terminal disclaimer.

(21) Appl. No.: 15/349,890

(22) Filed: Nov. 11, 2016

(65) Prior Publication Data

US 2017/0058497 A1 Mar. 2, 2017

Related U.S. Application Data

(63) Continuation of application No. 14/486,332, filed on Sep. 15, 2014, now Pat. No. 9,492,011, which is a (Continued)

(51) Int. Cl.

| | |
|---|---|
| ***E03C 1/18*** | (2006.01) |
| ***A47B 77/06*** | (2006.01) |
| *E03C 1/33* | (2006.01) |

(52) U.S. Cl.

CPC ..... *A47B 77/06* (2013.01); *E03C 1/18* (2013.01); *E03C 1/33* (2013.01); *E03C 1/335* (2013.01)

(58) Field of Classification Search

CPC ..... A47B 77/06

(Continued)

(56) References Cited

U.S. PATENT DOCUMENTS

| | | | |
|---|---|---|---|
| 2,023,692 | A | 12/1935 | McQuinn |
| 2,035,301 | A | 3/1936 | Daughtery |

(Continued)

FOREIGN PATENT DOCUMENTS

| | | |
|---|---|---|
| BE | 483814 | 7/1948 |
| CA | 2622792 | 9/2009 |

(Continued)

OTHER PUBLICATIONS

Product Installation Guide for Dawn Sink Model DAF3320, available as of Jan. 13, 2011.*

(Continued)

*Primary Examiner* — Erin Deery
(74) *Attorney, Agent, or Firm* — Foley & Lardner LLP

(57) ABSTRACT

A self-rimming sink is provided. The self-rimming sink includes a basin and a rim extending outwardly from an upper end of the basin in a relatively horizontal orientation. The rim is configured to be placed on top of a countertop for supporting the sink. The self-rimming sink also includes an apron coupled to the rim and defining a front portion of the sink. The apron has a front surface extending vertically below the rim and laterally between a first side surface and an opposite second side surface. The first and second side surfaces each having a front vertical lip that extends laterally to an outer periphery of the rim and a rear side wall portion. The rear side wall portion is recessed relative to the front vertical lip and the outer periphery of the rim.

15 Claims, 6 Drawing Sheets

Related U.S. Application Data continuation of application No. 13/310,481, filed on Dec. 2, 2011, now Pat. No. 8,844,070.

(60) Provisional application No. 61/449,589, filed on Mar. 4, 2011.

(58) Field of Classification Search
USPC ..... 4/619, 630, 628, 631–637, 584; D23/272–274, 284, 286, 292–293.1, 303, D23/308; 126/24 A, 37 R
See application file for complete search history.

(56) References Cited

U.S. PATENT DOCUMENTS

| | | | |
|---|---|---|---|
| 2,505,828 | A | 5/1950 | Fox |
| 2,629,880 | A | 3/1953 | Hartog |
| 2,646,575 | A | 7/1953 | Galley |
| 2,818,579 | A | 1/1958 | Katz |
| 2,878,091 | A | 3/1959 | Hammond |
| 2,897,516 | A | 8/1959 | Ensch |
| 2,996,730 | A | 8/1961 | Hornik |
| 3,001,209 | A | 9/1961 | Hammer |
| 3,029,446 | A | 4/1962 | Just |
| 3,040,338 | A | 6/1962 | Zeleny et al. |
| 3,051,160 | A | 8/1962 | Nielsen |
| 3,095,580 | A | 7/1963 | Just |
| 3,231,903 | A | 2/1966 | Cope |
| 3,813,707 | A | 6/1974 | Fowell |
| 4,002,383 | A | 1/1977 | Holloway |
| 4,016,608 | A | 4/1977 | Khan |
| 4,878,257 | A | 11/1989 | Hardin |
| D313,068 | S | 12/1990 | Kohler et al. |
| 5,016,297 | A | 5/1991 | Sauter et al. |
| 5,070,554 | A | 12/1991 | Bertoli |
| 5,201,306 | A | 4/1993 | Kinny |
| D353,652 | S | 12/1994 | Dannenberg |
| D358,457 | S | 5/1995 | Dannenberg |
| D394,487 | S | 5/1998 | Wilson |
| 5,931,151 | A | 8/1999 | Van Dore |
| 6,564,398 | B1 | 5/2003 | Trott |
| 6,745,416 | B2 | 6/2004 | Albarran |
| 6,782,593 | B1 | 8/2004 | Shimony |
| 6,785,918 | B2 | 9/2004 | Romo |
| 6,793,190 | B2 | 9/2004 | White et al. |
| D498,520 | S | 11/2004 | Rachiele |
| D501,541 | S | 2/2005 | Gordon |
| D518,560 | S | 4/2006 | Arkay-Liliever |
| D523,940 | S | 6/2006 | Trepanier |
| D524,078 | S | 7/2006 | Bruce |
| 7,246,387 | B2 * | 7/2007 | Erickson ..... A47B 77/06 4/631 |
| D558,311 | S | 12/2007 | Adams |
| D700,301 | S | 2/2014 | Rachiele |
| 2006/0195981 | A1 | 9/2006 | Yemini |
| 2008/0196158 | A1 | 8/2008 | Jones et al. |
| 2008/0313804 | A1 | 12/2008 | Osterroth et al. |
| 2010/0301175 | A1 | 12/2010 | Grayson |

FOREIGN PATENT DOCUMENTS

| | | |
|---|---|---|
| DE | 8535539 | 2/1986 |
| DE | 40 34 926 | 5/1991 |
| DE | 102006006404 | 8/2007 |
| EP | 1598489 | 11/2005 |
| EP | 2 088 250 | 2/2009 |
| FR | 2632838 | 12/1989 |

OTHER PUBLICATIONS

International Search Report regarding Application No. PCT/US2012/027306 dated Sep. 10, 2013.
International Search Report regarding Application No. PCT/US2012/027318 dated Sep. 10, 2013.
International Search Report regarding Application No. PCT/US2012/027303 dated Sep. 10, 2013.
U.S. Office Action dated Dec. 2, 2015, from related U.S. Appl. No. 13/325,768.
Notice of First Office Action in related CN Application No. 201280021521.4.
International Search Report and Written Opinion dated Jun. 26, 2012 in International Application No. PCT/US2012/027303.

* cited by examiner

SELF-RIMMING APRON-FRONT SINK

CROSS-REFERENCE TO RELATED PATENT APPLICATIONS

This application is a Continuation of U.S. application Ser. No. 14/486,332, filed Sep. 15, 2014 (now U.S. Pat. No. 9,492,011), which is a Continuation of U.S. application Ser. No. 13/310,481, filed Dec. 2, 2011 (now U.S. Pat. No. 8,844,070), which claims the benefit of and priority to U.S. Provisional Application No. 61/449,589, filed Mar. 4, 2011, the disclosures of the foregoing U.S. applications are hereby incorporated by reference herein in their entireties.

BACKGROUND

The present disclosure relates generally to the field of sinks. More specifically, the present disclosure relates to the field of self-rimming sinks having a front apron.

Sinks are vessels generally configured for receiving water. Usually, a faucet or other water source is located proximate to the sink, and a drain pipe is coupled to the sink to remove unwanted water. A sink is often mounted on or into a cabinet, stand, or pedestal. A sink may be mounted such that a rim of the sink rests on a countertop of a cabinet. This is generally referred to as self-rimming. Alternatively, a sink may be mounted such that the rim of the sink is located below the countertop. This is generally referred to as under-counter mounted or under-mounted.

Apron-front sinks, which include farmhouse sinks, have an exposed panel extending laterally across a front portion of the sink. One continuing challenge in the field of apron-front sinks relates to fitting the sink into the cabinet. Installation of an apron-front sink usually requires precise and repeated cuts to fit the sink to the front of the cabinet without leaving unsightly gaps between the apron and the cabinet. This custom fitting method takes time and requires an installer to repeatedly lift a heavy sink to check for fit.

Another continuing challenge in the field of apron-front sinks relates to retrofitting. Usually apron-front sinks will not fit into standard, stock, or off-the-shelf non-apron-front cabinetry due to the width of the sink and the height of the cabinet's lower doors. Alternatively, such retrofits require extensive modifications to the cabinet or installation of an undersized sink.

SUMMARY

One embodiment relates to a self-rimming sink. The self-rimming sink includes a basin and a rim extending outwardly from an upper end of the basin in a relatively horizontal orientation. The rim is configured to be placed on top of a countertop for supporting the sink. The self-rimming sink also includes an apron coupled to the rim and defining a front portion of the sink. The apron has a front surface extending vertically below the rim and laterally between a first side surface and an opposite second side surface. The first and second side surfaces each having a front vertical lip that extends laterally to an outer periphery of the rim and a rear side wall portion. The rear side wall portion is recessed relative to the front vertical lip and the outer periphery of the rim.

Another embodiment relates to a sink assembly. The sink assembly includes a cabinet having a front wall defining a vertical opening, a countertop supported on the cabinet and defining a horizontal opening that is generally aligned with the vertical opening of the cabinet and a sink supported by the countertop and received by vertical and horizontal openings. The sink includes a basin and a rim extending outwardly from an upper end of the basin in a relatively horizontal orientation. The rim is positioned on top of the countertop. The self-rimming sink also includes an apron coupled to the rim and defining a front portion of the sink. The apron has a front surface extending vertically below the rim and laterally between a first side surface and an opposite second side surface. The first and second side surfaces each having a front vertical lip that extends laterally to an outer periphery of the rim and a rear side wall portion. The rear side wall portion is recessed relative to the front vertical lip and the outer periphery of the rim.

Another embodiment relates to a method of installing a sink onto a cabinet that is supporting a countertop. The sink has a rim and an apron. The method includes the steps of providing a first opening in a front wall of the cabinet that is less than a width of the apron, providing a second opening in the countertop that is generally aligned with the first opening and configured to receive a portion of the apron, positioning the sink in the first and second openings, supporting the sink by having the rim sit on top of the countertop, positioning the sink so that a rear edge of a lateral side wall of the apron is adjacent to the front wall of the cabinet and received within the second opening, concealing the first opening with the apron, and at least partially concealing a cutting line in a front edge of the countertop that defines the second opening with a vertical lip provided along a front lateral edge of the apron.

DETAILED DESCRIPTION

Figure 1:
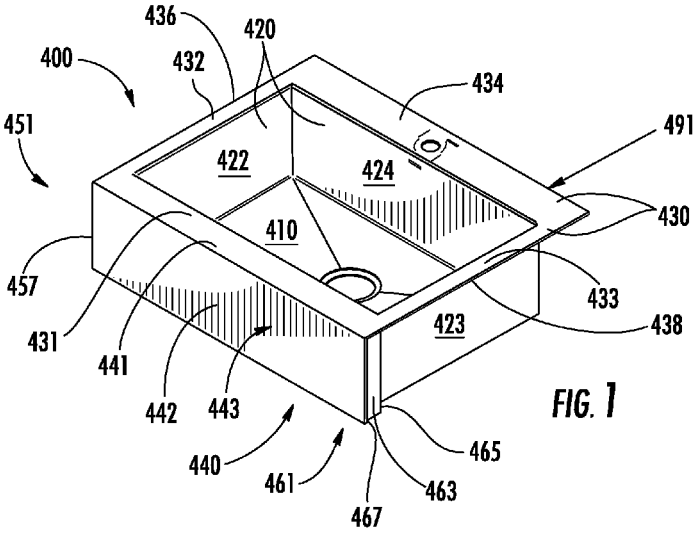
FIG. 1 is a perspective view of a sink, shown according to an exemplary embodiment.

Referring generally to the Figures, a sink and components thereof are shown according to exemplary embodiments. The sink may be installed in various environments including a kitchen or bathroom. The sinks are designed to replace and/or be installed in instead of a conventional sink to provide a user with the appearance of a traditional apron front or farmhouse sink without requiring significant modifications to the cabinetry or other support structures that may otherwise be required for traditional apron front and farmhouse sinks.

The sink generally includes one or more basins and a front apron coupled to the one or more basins. The one or more basins are defined by a floor and one or more sidewalls extending upwardly from the floor. The sink may have any number of basins. For example, the sink may have one, two, or more basins. Alternatively, the sink may have a single basin divided into two or more reservoirs. The basins or reservoirs may be separated by one or more dividers (e.g., separator, structure, hump, ridge, etc.), such as a saddle. The saddle may be of any height, but preferably remains below the rim plane of the sink. The saddle may divide the sink into multiple equal or unequal sized basins or reservoirs.

The sink also includes a flange or rim outwardly extending from a top edge or portion of the sidewalls. The sink is a self-rimming sink, and the rim is configured to be supported on top of a countertop. The apron, which is coupled to the front wall of the basin via the same or similar rim, extends downwardly from the rim and laterally between a first end and a second end to define a front portion of the sink. The first and second ends of the apron extend laterally beyond the outer periphery of the basin. Extending the ends of the apron past the outer periphery of the basin may allow the ends of the apron to at least partially overlap a face of the cabinetry to conceal possible cut lines and/or openings in the face of the cabinetry. Further, the first and second ends of the apron each have a raised front edge or projection that is substantially even with or coplanar with the rim. The remainder of the first and second ends are recessed inward and are supported under the rim. The raised front edge may be able to hide or otherwise conceal a cutting line made in the countertop that is necessary for the countertop to receive the sink.

Before discussing further details of the sink and/or the components thereof, it should be noted that references to "front," "back," "rear," "upper," "lower," "right," and "left" in this description are merely used to identify the various elements as they are oriented in the Figures, with "right," "left," "front," "back," and "rear" being relative to a user facing the sink, and with "lateral" being left-right as viewed by the user. These terms are not meant to limit the element which they describe, as the various elements may be oriented differently in various applications.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring to FIG. 1, a perspective view of a sink 400 is shown according to an exemplary embodiment. Sink 400 includes at least one receptacle for receiving and/or holding water (e.g., reservoir, washbasin, bowl, etc.), shown as basin 401. Basin 401 may have a variety of shapes, for example, circular, oval, polygonal, or sections of the shapes thereof (e.g. circular sector). According to the embodiment shown, basin 401 is substantially rectangular with a lateral width dimension (i.e., side-to-side) being greater than the depth dimension (i.e., front-to-back).

Basin 401 is shown as including a floor 410. As shown, floor 410 includes one or more sections which are each substantially planar. According to the various alternative embodiments, the sections of floor 410 may be non-planar, or the sidewalls of basin 401 may be continuously curved such that no discernable floor is formed. Floor 410 defines one or more apertures, shown as drain hole, that allow water to be removed from basin 401. The drain is configured to be coupled to a drain pipe and/or a garbage disposal mechanism, which is in turn coupled to a municipal sewerage system or to a septic system. Floor 410 is shown as being sloped towards the drain. For example, segments for floor 410 are each sloped towards the drain such that water in basin 401 may flow towards the drain by gravitational force.

Basin 401 is also shown as including one or more sidewalls (generically referred to as sidewall 420) which extend generally upwardly from floor 410. According to the embodiment illustrated, basin 401 includes a first through fourth sidewalls, shown as front sidewall 421 (e.g., the sidewall of the front portion), a left sidewall 422, a right sidewall 423, and a rear sidewall 424. Front sidewall 421 extends laterally across a front portion of basin 401, rear sidewall 424 extends laterally across a rear portion of basin 401, left sidewall 422 extends front-to-back between front sidewall 421 and rear sidewall 424 along a first side portion of basin 401 (i.e., a left side portion) and right sidewall 423 extends front-to-back between front sidewall 421 and rear sidewall 424 along a second side portion of basin 401 (i.e., a right side portion). According to the embodiment shown, sidewalls 420 are substantially vertical.

According to an exemplary embodiment, sidewalls 420 are coupled to floor 410 at substantially angled corners. According to an exemplary embodiment, the angle between sidewalls 420 and segments of floor 410 is between approximately 94 degrees and 99 degrees. According to the various alternative embodiments, the corners may be continuously curved or have discontinuously curved surface transitions from floor 410 to sidewall 420. Each of corners floor 410 to front sidewall 421, floor 410 to left sidewall 422, floor 410 to right sidewall 423, and floor 410 to rear sidewall 424 may have the same or different angle.

According to an exemplary embodiment, sidewalls 420 are coupled to each other at substantially right angles. According to the various alternative embodiments, the corners may be continuously curved or have discontinuously curved surface transitions from sidewall 420 to adjacent to sidewall 420. The angles for each of corners front sidewall 421 to left sidewall 422, left sidewall 422 to rear sidewall 424, rear sidewall 424 to right sidewall 423, and right sidewall 423 to front sidewall 421 may be the same or different.

Basin 401 is further shown as including one or more flanges or rims (generically referred to as rim 430) that at least partially define an outer and/or upper periphery of basin 401. Rim 430 is shown as being provided at a top portion of sidewall 420 and extending generally outwardly therefrom. According to an exemplary embodiment, rim 430 is configured to be exposed after installation and define the upper periphery of the sink. As a self-rimming sink, rim 430 is also configured to at least partially support sink 400 by resting on top of a countertop or any other suitable support surface such that an underside surface of rim 430 supports basin 401.

According to an exemplary embodiment, basin 401 includes a front rim 431, a left rim 432, a right rim 433, and a rear rim 434. Front rim 431 extends from a top portion of front sidewall 421, left rim 432 extends from a top portion of left sidewall 422, right rim 433 extends from a top portion of right sidewall 423, and rear rim 434 extends from a top portion of rear sidewall 424. The thickness of rim 430 may be the same or different than the thickness of sidewall 420. Further, the individual thicknesses of each of front rim 431, left rim 432, right rim 433, and rear rim 434 may be the same or different. According to the embodiment illustrated, front rim 431, left rim 432, right rim 433, and rear rim 434 have substantially the same thickness. According to the embodiment illustrated, left rim 432 and right rim 433 have a substantially similar width, rear rim 434 has a substantially greater width. According to an exemplary embodiment, rear rim 434 has a greater width so that it can define one or more openings configured to receive a fixture (e.g., faucet, sprayer, soap dispenser, water controls, etc.). According to the various alternative embodiments, the width dimension may be the same for each of front rim 431, left rim 432, right rim 433, and/or rear rim 434. Front rim 431, left rim 432, right rim 433, and rear rim 434 are shown to form a continuous rim surface. According to the various alternative embodiments, rim 430 may be formed of discontinuous rim segments.

According to an exemplary embodiment, each rim 430 is coupled to each adjacent sidewall 420 at substantially right angles. According to the various alternative embodiments, the corners may be continuously curved or provide discontinuously curved surface transitions from rim 430 to adjacent to sidewall 420. Each of the corners between front rim 431 to front sidewall 421, left rim 432 to left sidewall 422, right rim 433 to right sidewall 423, and rear rim 434 to rear sidewall 424 may have the same or different angles.

Rim 430 defines a first plane (e.g., top plane), shown as rim plane 491. According to the embodiment illustrated, front rim 431, left rim 432, right rim 433 and rear rim 434 cooperate to define rim plane 491. According to an exemplary embodiment, rim plane 491 is a substantially horizontal plane.

Referring back to FIG. 2, left rim 432 has a first edge, shown as left rim edge 436, and right rim 433 has a second edge, shown as right rim edge 438. Left rim edge 436 and/or right rim edge 438 may at least partially define a periphery of basin 401. According to an exemplary embodiment, the distance from left rim edge 436 to right rim edge 438 is approximately 36 inches, and the distance from left sidewall 422 to right sidewall 423 is approximately 32.5 inches. According to another exemplary embodiment, left rim edge 436 and right rim edge 438 are approximately 33 inches apart for a reservoir that has a width of approximately 29.5 inches. According to the embodiment illustrated, left rim edge 336 and right rim edge 338 are approximately 30 inches apart for a reservoir that has a width of approximately 26.5 inches. According to the various exemplary embodiments, the rim may be sized to be greater or less than the dimensions provided above.

Sink 400 also includes an apron 440 the extends laterally across a front portion of sink 400 to define a front portion of the sink that is configured to be visible to a user when installed. As shown, apron 440 is coupled to basin 401 and is supported at a substantially vertical orientation. According to an exemplary embodiment, apron 440 includes a first surface (e.g., structure, member, etc.), shown as top flange 441, a second surface (e.g., structure, member, etc.) shown as front face 442, a first end surface, shown as left end portion 451, and a second end surface, shown as right end portion 461. Left end portion 451 is shown as being located laterally opposite of right end portion 461.

Top flange 441 extends outwardly in a forward direction from a top portion of front sidewall 421 and front rim 431. According to various embodiments, a top surface of apron 440 may be substantially defined by top flange 441, front rim 431, or any combination thereof. According to the embodiment illustrated, the transition from top flange 441 to front rim 431 is substantially continuous. Similarly, the transition from top flange 441 to left rim 432, and the transition from top flange 441 to right rim 433, is also substantially continuous. According to an exemplary embodiment, front face 442 extends generally downwardly from top flange 441 in a vertical direction.

Top flange 441 is shown to extend laterally to left end portion 451 and to right end portion 461. Left end portion 451 and right end portion 461 may form extension or wing portions that are configured to at least partially overlap or cover a portion of the cabinetry or other structure upon which the sink is supported. Left end portion 451 includes an end surface, shown as left end surface 453 that extends generally rearwardly and substantially perpendicular to front face 442. Left end portion 451 also includes rear edge 455 that forms a rearward extremity of left end portion 451 and/or left end surface 453. Left end portion 451 further includes a front edge 457 that forms a lateral extremity of apron 440. According to the exemplary embodiment, left end surface 453 is recessed laterally from front edge 457. In other words, front edge 457 extends in a lateral direction beyond the left end surface 453.

Similarly, right end portion 461 includes an end surface, shown as right end surface 463 that extends generally rearwardly and substantially perpendicular to front face 442. Right end portion 461 also includes rear edge 465 that forms a rearward extremity of left end portion 461 and/or right end surface 463. Right end portion 461 further includes a front edge 467 that forms a lateral extremity of apron 440. According to the exemplary embodiment, right end surface 463 is recessed laterally from front edge 467. In other words, front edge 467 extends in a lateral direction beyond the left end surface 453.

Figure 2:
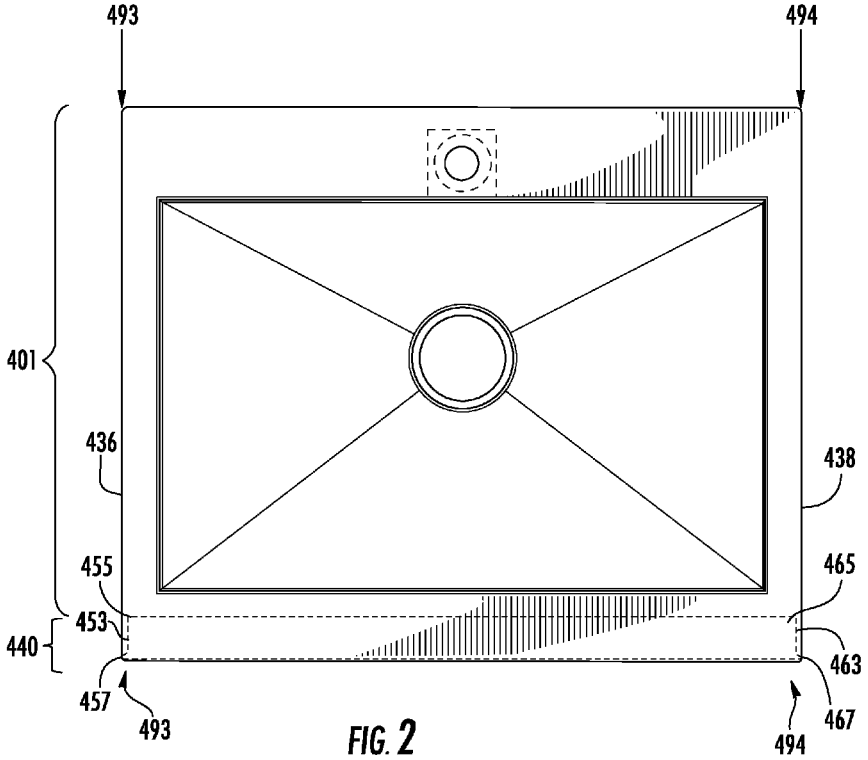
FIG. 2 is a top planar view of the sink of FIG. 1, shown according to an exemplary embodiment.

Referring to FIG. 2, a top view of sink 400 is shown according to an exemplary embodiment. According to the embodiment illustrated, apron 440 extends laterally between left rim edge 436 and to right rim edge 438. However, only between front edge 457 and front edge 467 does apron 440 extend the entire distance between left rim edge 436 and to right rim edge 438. The lateral distance from left end surface 453 to right end surface 463 is less than the lateral distance from left rim edge 436 and to right rim edge 438. In such an embodiment, left end surface 453 and right end surface 463 are inwardly offset or recessed relative to left rim edge 436 and to right rim edge 438 respectively. As detailed below, during installation, left end surface 453 and right end surface 463 are configured to be received within the opening that has been cutout in a countertop to receive sink 400. By having front edge 457 and front edge 467 extend laterally beyond left end surface 453 and right end surface 463 respectively, front edge 457 and front edge 467 can conceal or otherwise hide a cutting line made in the countertop and/or cabinetry that is necessary to receive sink 401.

Figure 4:
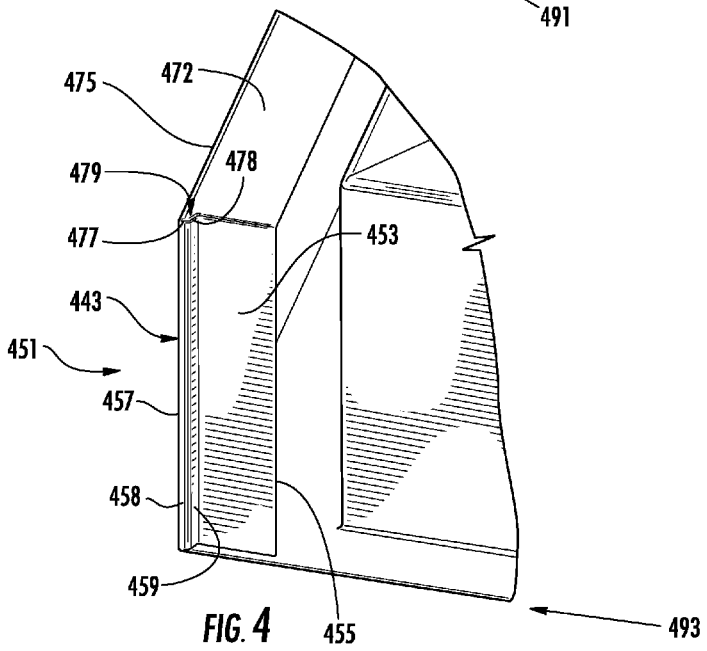
FIG. 4 is an enlarged view of the sink of FIG. 1, shown according to an exemplary embodiment.

Referring to FIG. 4, an enlarged view of left end portion 451 is shown according to an exemplary embodiment. The description of left end portion 451 may be transferred to right end portion 461. Front edge 457 is a raised edge or lip formed by a projection extending from left end surface 453 or by any other structure. According to the embodiment illustrated, front edge 457 is formed by bending or otherwise shaping the sheet material (e.g., stainless steel, etc.) used to define left end portion 451. After shaping the sheet material, left end portion 451 is left with multiple surfaces. Specifically, left end portion 451 is shown as including left end surface 453, a first transition surface 458 and a second transition surface 459. First transition surface 458 and second transition surface 459 are shown to be substantially vertical and extending the entire height of the apron. First transition surface 458 extends rearwardly from front face 442 and is substantially perpendicular to front face 442. As shown, first transition surface 458 is substantially coplanar with left rim edge 436 (which defines a left side plane 493). According to the various alternative embodiments, first transition surface 458 may be rounded and tangential to left side plane 493. As shown, second transition surface 459 extends inward between first transition surface 458 and left end surface 453 at an angle of approximately 30 degrees relative to front face 442. According to the various alternative embodiments, second transition surface 459 can extend inward at an angle that is sufficient to recess left end surface 453 relative to the lateral front edge of the apron.

Figure 3:
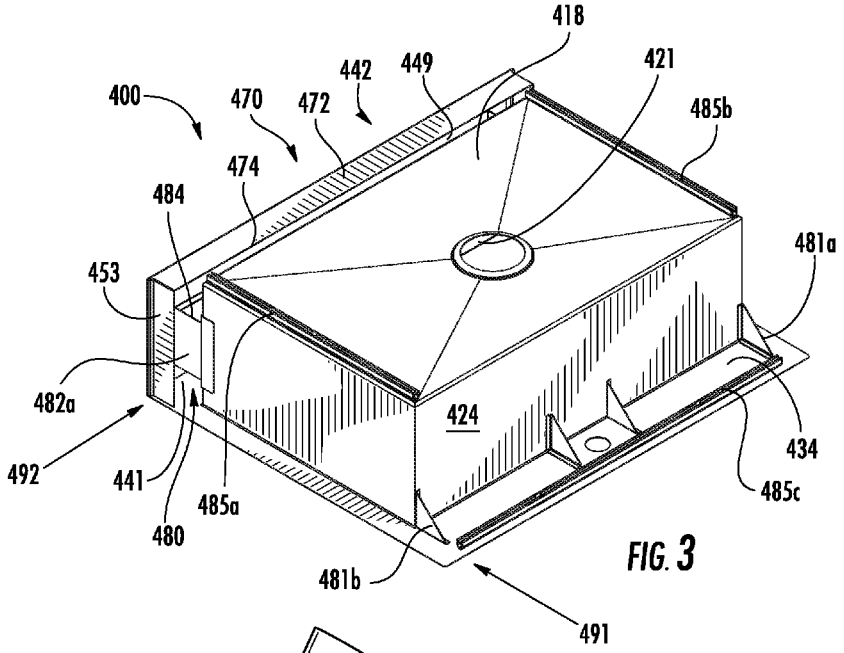
FIG. 3 is a bottom perspective view of the sink of FIG. 1, shown according to an exemplary embodiment.

Referring to FIG. 3, a bottom perspective view of sink 400 is shown according to an exemplary embodiment. Apron 440 is shown as including a third end portion, shown as bottom end portion 470. Bottom end portion 470 includes a third end surface, shown as bottom end surface 472. Bottom end surface 472 extends generally rearwardly from front face 442. According to the embodiment illustrated, bottom end portion 470 has a rear edge 474 that forms a bottom extremity of apron 440. According to an exemplary embodiment, rear edge 474 is coplanar with rear apron plane 492.

According to an exemplary embodiment, bottom end surface 472 couples each of front face 442, left end surface 453, and right end surface 463 at substantially right angles. According to the various alternative embodiments, the corners may be continuously curved or provide discontinuously curved surface transitions from the bottom end surface to the adjacent surfaces. Each of corners bottom end surface 472 to front face 442, bottom end surface 472 to left end surface 453, and bottom end surface 472 to right end surface 463 may be the same or different angles.

Referring to FIG. 4, front face 442 is shown as including a first bottom edge 475, while first transition surface 458 is shown as including a second bottom edge 477 and second transition surface is shown as including a third bottom edge 478. First bottom edge 475, second bottom edge 477, and third bottom edge 478, define an area 479 that is configured to receive a portion of bottom end surface 472.

The height of apron 440 may vary depending on the application. For example, sink 400 may include a full apron or a short apron. According to the embodiment illustrated, apron 440 is a relatively short apron having a height between approximately 6 and 7 inches. The height is being defined as the distance between top flange 441 and bottom end surface 472 of apron 440. According to the various alternative embodiments, sink 400 may include a full apron, which descends between 8 inches and 9 inches from rim plane 491.

Sink 400 may include a second plane, shown as rear apron plane 492, defined by left end 455 and right end 465. According to an exemplary embodiment, rear apron plane 492 is defined by left end 455, right end 465, and bottom end 474. Rear apron plane 492 is substantially vertical and is substantially perpendicular to left side plane 493, to right side plane 494, and to rim plane 491. Rear apron plane 492 is also substantially parallel to front face 442, front surface 443, and front sidewall 421. Rear apron plane 492 is be configured to abut a front surface of a cabinet when sink 400 is in an installed position. Rear apron plane 492 is configured to be substantially flush to a front surface of a cabinet when sink 400 is in an installed position. Having a substantially vertical rear apron plane provides a substantially flat backside to the apron. As such, when sink 400 is installed, the apron may fit flush against the front of the cabinet instead of dropping into a cut or an opening. This saves the installer iterative cutting and fitting, which requires repeated lifting of a heavy sink Apron 440 may define a cavity (e.g., recess, depression, carve-out, hollow, etc.), shown as cavity 480 in FIG. 3. According to one embodiment, top flange 441, front face 442, left end portion 451, and right end portion 461 at least partially define cavity 480. According to the embodiment shown, cavity 480 is further defined by bottom end portion 470. Cavity 480 may extend substantially between bottom end portion 470 and top flange 441. Cavity 480 may extend substantially between top flange 441 and bottom end surface 472. According to an exemplary embodiment, apron 440 has a cross sectional shape that is substantially C-shaped in a vertical direction, with the opening of the "C" facing rearwardly towards basin 401.

Apron 440 is also shown as including a structure (e.g., member, reinforcement, etc.), shown as beam 484. Beam 484 is shown disposed to extend laterally across rear surface 449. Beam 484 may be coupled to rear surface 449 in a variety of methods. According to an exemplary embodiment, beam 484 is coupled to rear surface 449 with an adhesive.

According to an exemplary embodiment, bottom end portion 470, bottom end surface 472, and bottom end 474 are offset from front sidewall 421. According to the embodiment illustrated, no supports (e.g. structures, members, brace, spars, flanges, webs, etc.) extend from a bottom portion of front sidewall 421 to apron 440 or from front sidewall 421 to bottom end portion 470 or from front sidewall 421 to bottom end surface 472 or from front sidewall 421 to bottom end 474. Disconnecting the bottom of apron 440 from front sidewall 421 enables a portion the cabinet to fit between the apron and the basin. This enables apron 440 to be installed flush to a front face of the cabinet. Further this requires less precise cutting by an installer because the cut edges of the cabinet will be hidden from view.

Sink 400 may include one or more supports (e.g. structures, members, spars, flanges, webs, etc.) which extend from a middle portion of basin 401 to apron 440. According to an exemplary embodiment, sink 400 includes a first support, shown as left support 482*a*, and a second support, shown as right support 482*b*, which are substantially similar to supports 382.

Sink 400 may include one or more braces 481 (e.g., supports, structures, members, brace, spars, flanges, webs, etc.). According to the embodiment illustrated, sink 400 includes four braces 481. Brace 481 may include a first side coupled to rear sidewall 424 and a second side coupled to rim 430. For example, brace 481 includes a first side coupled to an outer surface of rear sidewall 424 and a second side coupled to an underside of rear rim 434. According to an exemplary embodiment, brace 481 is configured to support rear rim 434 perpendicularly to rear sidewall 424 and to reduce deflection of rim 430. As shown, brace 481 is substantially triangular, but according to various alternate embodiments may have a variety of shapes.

Referring to FIG. 3, sink 400 is shown as including one or more channels 485 (e.g., rail, conduit, structure, member, bracket, etc.). According to the embodiment illustrated, sink 400 includes three channels 485: a first channel, shown as left channel 485*a*, a second channel, shown as right channel 485*b*, and a third channel, shown as rear channel 485*c*. Left channel 485*a* extends rearwardly along an underside of floor 410. Right channel 485*b* extends rearwardly along an underside of floor 410. According to an exemplary embodiment, left channel 485*a* extends along a left portion of bottom surface 418 of floor 410 and right channel 485*b* extends rearwardly along a right portion of bottom surface 418 of floor 410. Rear channel 485*c* extends laterally across an underside of rear rim 434. According to an exemplary embodiment, a lateral length of rear channel 485*c* is less than the distance between left sidewall 422 and right sidewall 423. According to the embodiment illustrated, a first end of rear channel 485*c* is offset inwardly from a plane defined by left sidewall 422, and a second end of rear channel 485*c* is offset inwardly from a plane defined by right sidewall 423. Limiting the length of channel 485*c* facilitates maximizing the width of the reservoir between left sidewall 422 and right sidewall 423 that may be inserted through a sink opening in a countertop. Channels 485 are shown to be continuous channels. According to the various alternative embodiments, channels 485 may comprise discontinuous segments. According to further alternative embodiments, sink 400 may or may not include channel 485*c*.

Figure 5:
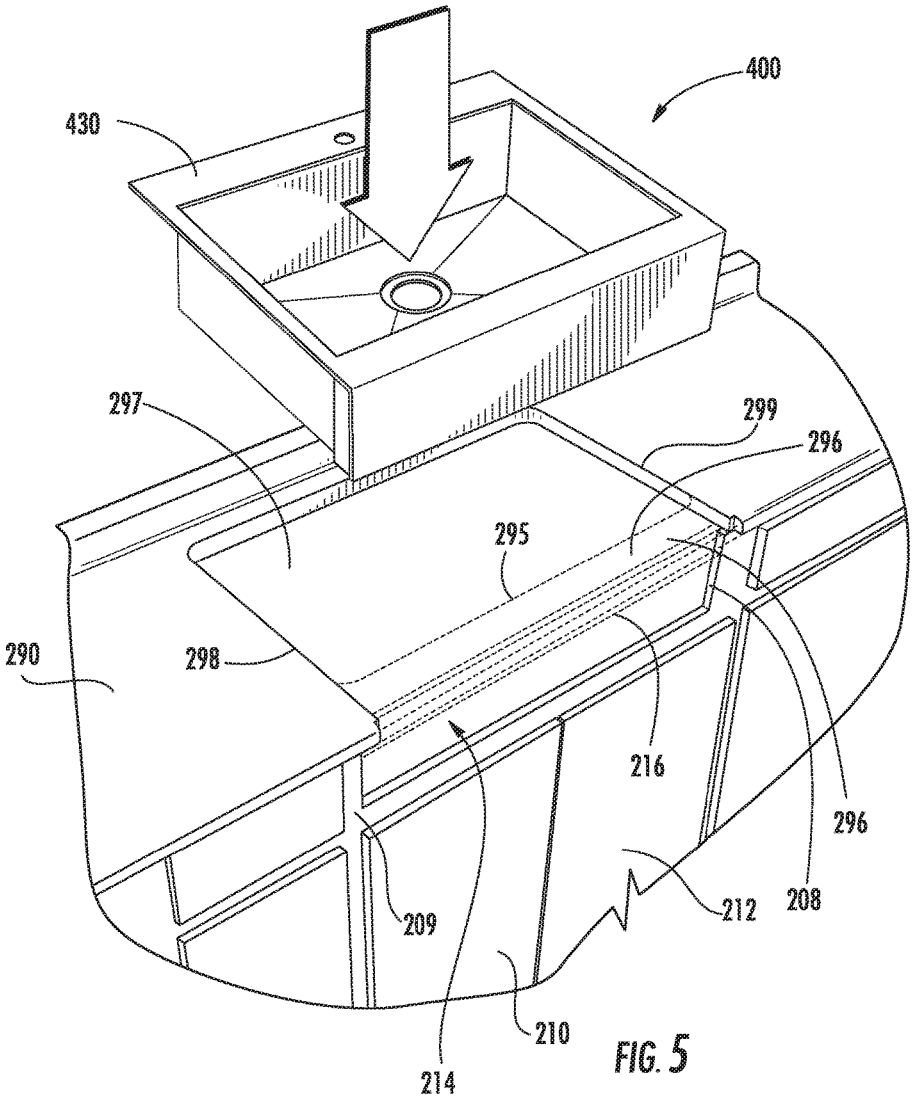
FIG. 5 is a perspective view schematic drawing of installing a sink into a cabinet, shown according to an exemplary embodiment.
Figure 6:
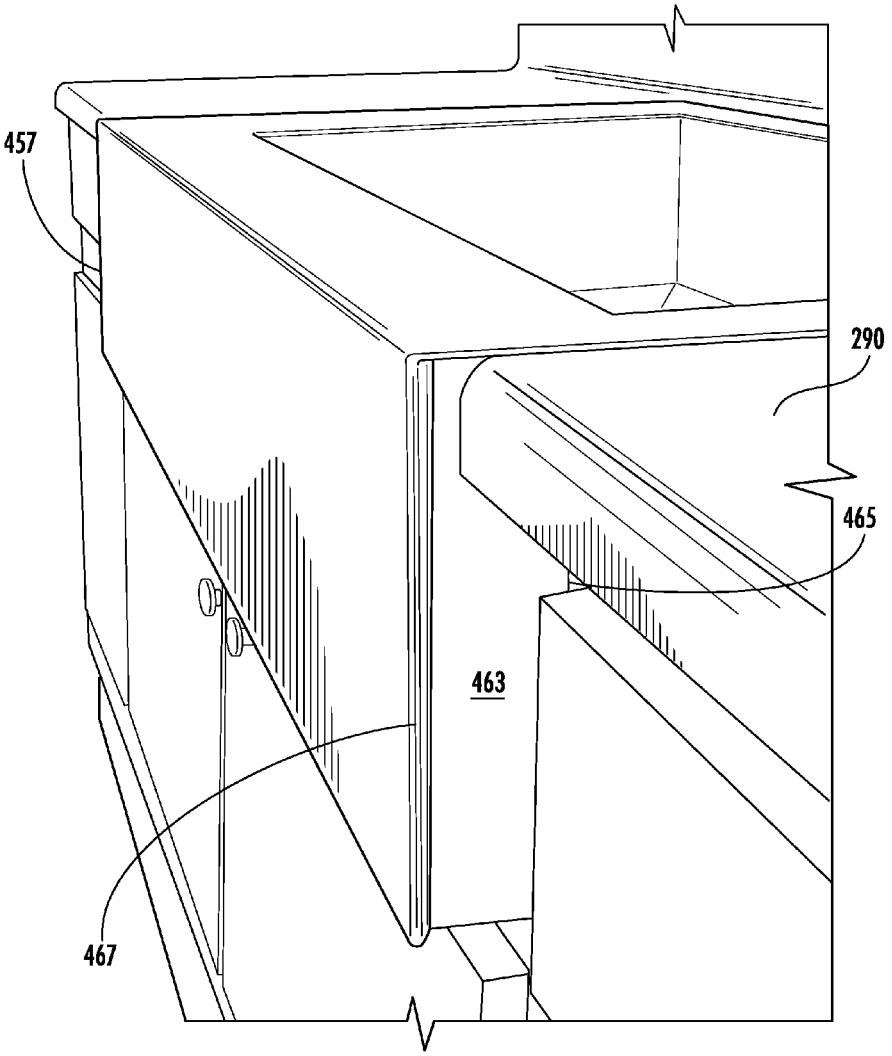
FIG. 6 is an enlarged perspective view of the sink of FIG. 1 installed in a cabinet, shown according to an exemplary embodiment.

Referring to FIGS. 5 and 6, a method of installing sink 400 into a cabinet (e.g. stand, structure, base cabinet, sink base cabinet etc.), shown as cabinet 200, is shown according to an exemplary embodiment. Cabinet 200 may be a stock, standard, or custom cabinet generally known in the art. Cabinet 200 may have front panel 208. Front panel 208 may include front surface 209. Cabinet 200 may further include at least one door movably disposed on a lower portion of front panel 208. As shown, cabinet 200 includes first door, shown as left door 210, and a second door, shown as right door 212. Left door 210 includes a first edge shown as left vertical edge 211. Right door 212 includes a second edge, shown as right vertical edge 213. Front panel 208 may define an aperture, shown as drawer opening 214, above doors 210 and 212. According to an exemplary embodiment, drawer opening 214 is configured to receive one or more drawers which slidably couple to cabinet 200. According to the exemplary embodiment, cabinet 200 includes one or more false drawer panels which cover drawer opening 214.

Cabinet 200 supports a countertop 290. Countertop 290 includes an aperture, shown as sink opening 297, configured to receive a sink and at least partially defined by a first edge, shown as left edge 298, a second edge, shown as right edge 299, and third edge, shown as front edge 295. As shown, a region 296 of countertop 290 includes front edge 295 and extends laterally across a top front portion of cabinet 200. According to an exemplary embodiment, region 296 extends from left edge 298 to right edge 299. Front panel 208 may include a rail 216, extending across a top front portion of cabinet 200, supporting region 296 of countertop 290, and at least partially defining aperture 214. Front panel 208 may include a support member, referred to as center support 218, which extends vertically through aperture 214 and supports rail 216. As described, cabinet 200 may not be configured to receive a traditional apron-front sink.

If cabinet 200 is already supporting a sink, the existing sink will first need to be removed from cabinet. If cabinet 200 includes one or more drawers received in drawer opening 214 or one or more false drawer panels, the drawers and false drawer panels should be removed. If cabinet 200 includes countertop region 296 and rail 216, the countertop region 296 and rail 216 should be removed by completing the following steps: making a first substantially vertical cut in countertop 290 substantially even with a left edge 298 of sink opening 297; and making a second substantially vertical cut into countertop 290 substantially even with a right edge 299 of sink opening 297. The first substantially vertical cut creates a substantially linear extension of left edge 298, and the second substantially vertical cut creates a substantially linear extension of right edge 299. The first and second substantially vertical cuts should extend below the top of drawer opening 214 and below the bottom of rail 216. Additional steps may include: making a first substantially horizontal cut parallel to a bottom surface of rail 216 until the first substantially horizontal cut intersects the first substantially vertical cut; and making a second substantially horizontal cut parallel to a bottom surface of rail 216 until the second substantially horizontal cut intersects the second substantially vertical cut. The first substantially horizontal cut and the second substantially horizontal cut should be substantially even with a top of drawer opening 214. If cabinet 200 includes center support 218, a third substantially horizontal cut may need to be made through center support 218. The third substantially horizontally cut should be substantially even with the bottom of drawer opening 214. Once the cuts have been made, rail 216, center support 218 and/or countertop region 296 may be removed.

Additional installation steps may include: making a third substantially vertical cut into countertop 290 extending leftward from the first substantially vertical cut (the third substantially vertical cut being substantially parallel to, and substantially flush with, front surface 209); making a fourth substantially vertical cut into countertop 290 (the fourth substantially vertical cut being in a fore-aft direction extending from a front edge of the countertop to front surface 209 of the cabinet). The fourth substantially vertical cut may be located such that it abuts left end surface 453 of sink 400 when sink 400 is in an installed position. The third and fourth substantially vertical cuts form a notch or cut-out in a front edge of countertop 290. Further installation step may include: making a fifth substantially vertical cut into countertop 290 extending right word from the second substantially vertical cut (the fifth substantially vertical cut may being substantially parallel to, and substantially flush with, front surface 209); and making a sixth substantially vertical cut into countertop 290 (the sixth substantially vertical cut being in a fore aft direction extending from a front edge of the countertop to front surface 209 of the cabinet). The sixth substantially vertical cut may be located such that it abuts right end surface 463 of sink 400 when sink 400 is in an installed position. The fifth and sixth substantially vertical cuts form a notch or cut-out in a front edge of countertop 290. The cut-outs formed by the third through sixth substantially vertical cuts may be located such that they will receive a portion of apron 440 and be covered by rim 430 when sink 400 is in an installed position. Additional working (e.g., cutting, chiseling, sanding, etc.) may be performed in order to align the third and fifth substantially vertical cuts with front surface 209. According to one embodiment, measurements may be marked on countertop 290 to indicate locations to be cut. According to another embodiment, a template may be placed onto countertop 290. According to the exemplary embodiment, a template is centered on the desired sink location and aligned with front surface 209 of cabinet 200. A tracing of the template is made onto countertop 290, and the cuts are made.

According to an another exemplary embodiment, sink 400 may be installed into a new countertop. In such an embodiment, countertop 290 may not include sink opening 297. According to one embodiment, measurements may be marked on countertop 290 to indicate locations to be cut. According to the exemplary embodiment, a template is centered on the desired sink location and aligned with front surface 209 of cabinet 200. A tracing of the template is made onto countertop 290, and the cuts are made. In addition to the cuts described in the embodiment above additional substantially vertical cuts may need to be made to define sink opening 297. According to one embodiment, the first substantially vertical cut extends rearward into countertop 290 to form left edge 298, and the second substantially vertical cut extends rearward into countertop 290 to form right edge 299. An additional cut may be made to define a rear edge of sink opening 297. According to another embodiment, the first substantially vertical cut, the second substantially vertical cut, and the substantially vertical cut defining the rear edge of sink opening 297 may be made as a single continuous cut.

A further installation step may include placing (e.g., lower, set, etc.) sink 400 into sink opening 297. If necessary, sink 400 may need to be pushed in a rearward direction along countertop 290 to an installed position. According to an exemplary embodiment, in an installed position, rim 430 will be substantially supported by countertop 290 and rim plane 491 is substantially parallel with countertop 290. Also, left end 455, right end 465, and/or bottom end 474 are substantially flush with a front surface 209 of cabinet 200, while rear apron plane 492 is substantially flush with a front surface 209 of cabinet 200. According to an exemplary embodiment, apron 440 of sink 400 extends beyond drawer opening 214. According to the embodiment illustrated, the lateral distance from left end surface 453 to right end surface 463 is greater than a lateral width of drawer opening 214. As shown, bottom end surface 472 is below a bottom of drawer opening 214. With sink 400 in place, a clamping assembly may be used to secure the sink to the countertop and/or the cabinet.

According to various embodiments, the short apron configuration of sink 400 enables taller doors 210 and 212 to be used, enables non-apron-front height doors to be installed onto cabinet 200, and/or enables standard height doors to be installed onto sink 400. According to another embodiment, the short apron configuration of sink 400 enables doors 210 and 212 to be the same height as adjacent doors. Enabling full height doors facilitates retrofitting sink 400 into pre-existing cabinetry. According to the embodiment shown, left end surface 453 and right end surface 463 of sink 400 are configured to substantially align with left vertical edge 211 and right vertical edge 213, respectively. According to another embodiment, left apron end 457 and right apron end 467 are configured to substantially align with left vertical edge 211 and right vertical edge 213, respectively. According to the exemplary embodiment, bottom end surface 472 of sink 400 is configured to substantially align with bottom edges of adjacent drawers.

Referring to FIG. 6, a perspective view of sink 400 is shown installed according to an exemplary embodiment. Rim 430 is shown resting on a countertop of cabinet 200. While rim 430 is described as configured to be installed above a countertop, it is contemplated that rim 430 may be installed below a countertop. Countertop 290 is shown to extend under rim 430 to right end surface 463. As such, countertop 290 extends into the recess between right end surface 463 and right side plane 494. In this configuration, water from rim 430 or countertop 290 will not flow into a gap between sink 400 and countertop 290. Furthermore, the cuts made into a top surface of countertop 290 during installation are hidden from view by rim 430, thus reducing the precision needed during cutting for an aesthetically pleasing result. Similarly, front edge 467 extends laterally beyond the vertical cuts made into countertop 290 during installation, thus hiding the cuts from view and reducing the precision needed during cutting. A similar configuration also occurs on the left side of sink 400.

According to one embodiment, the distance from front edge 457 to front edge 467 is greater than the distance from left edge 298 to right edge 299 of sink opening 297. According to another embodiment, the distance from front edge 457 to front edge 467 is greater than the distance from the first substantially vertical cut to the second substantially vertical cut.

Figure 7:
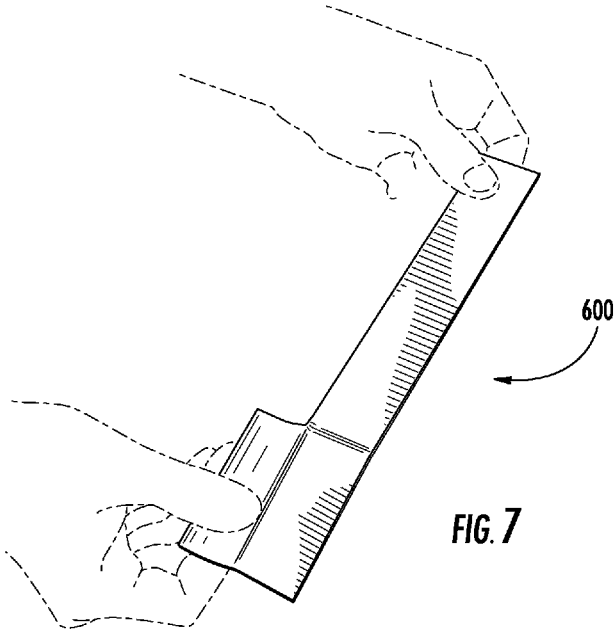
FIG. 7 is a perspective view of a template, shown according to an exemplary embodiment.
Figure 8:
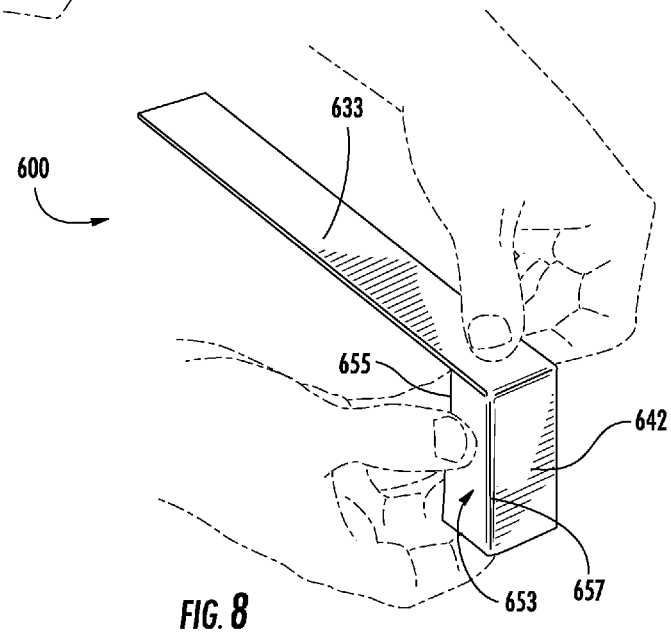
FIG. 8 is a perspective view of the template of 7, shown according to an exemplary embodiment.

Referring to FIGS. 7 and 8, a template 600 is shown according to an exemplary embodiment. Referring to FIG. 8 in particular, template 600 is configured to inform a user if sink 400 will fit into cabinet 200 and/or countertop 290. According to the embodiment shown, template 600 models a left portion of sink 400. According to an alternative embodiment, the template 600 may models a right portion of sink 400. Template 600 is shown as including a top surface 633. Top surface 633 has a length in a rearward direction substantially equal to the distance from front surface 443 of sink 400 to a rear edge of rear rim 434. Template 600 is also shown as including a front surface 642 which extends downwardly from top surface 633 a distance substantially equal to the height of apron 640. As shown, template 600 includes a first end 657, a second end 655, and an end surface 653 which are configured relative to top surface 633 and front surface 642 as front edge 457, left end 455, and left end surface 453 are configured relative to top flange 441 and front face 442. According to an alternative embodiment, end surface 653 may include an opening (e.g., notch, cutout, etc.) to enable template 600 to be placed over a pre-existing countertop. As such, the opening in end surface 653 would receive a front portion of a countertop.

When positioned over an existing countertop, template 600 will inform a user if the countertop for the proposed installation is deep enough to receive sink 400, if and how far apron 440 will extend forward of a front edge of the countertop, and if and how far apron 440 will extend below a bottom edge of drawer opening 214. Template 600 may further inform a user if edges of sink 400 will align with existing cabinet doors and/or drawers.

Template 600 may be provided on any suitable material. According to an exemplary embodiment, template 600 is made from a rigid or semi-rigid material, for example, plastic or metal. According to another embodiment, template 600 is printed on a paper-based material (e.g., paper, cardboard, corrugated paper, etc.). According to the embodiment illustrated, template 600 is printed on cardboard. As shown in FIG. 7, template 600 may be provided in a first state (e.g., flattened state, unfolded state, unassembled state, etc.). As necessary, template 600 may be removed from surrounding paper (e.g., cut, torn, broken perforations, etc.). Template 600 may be manipulated (e.g., folded, bent, assembled, etc.) into a second state shown in FIG. 8.

Figure 9:
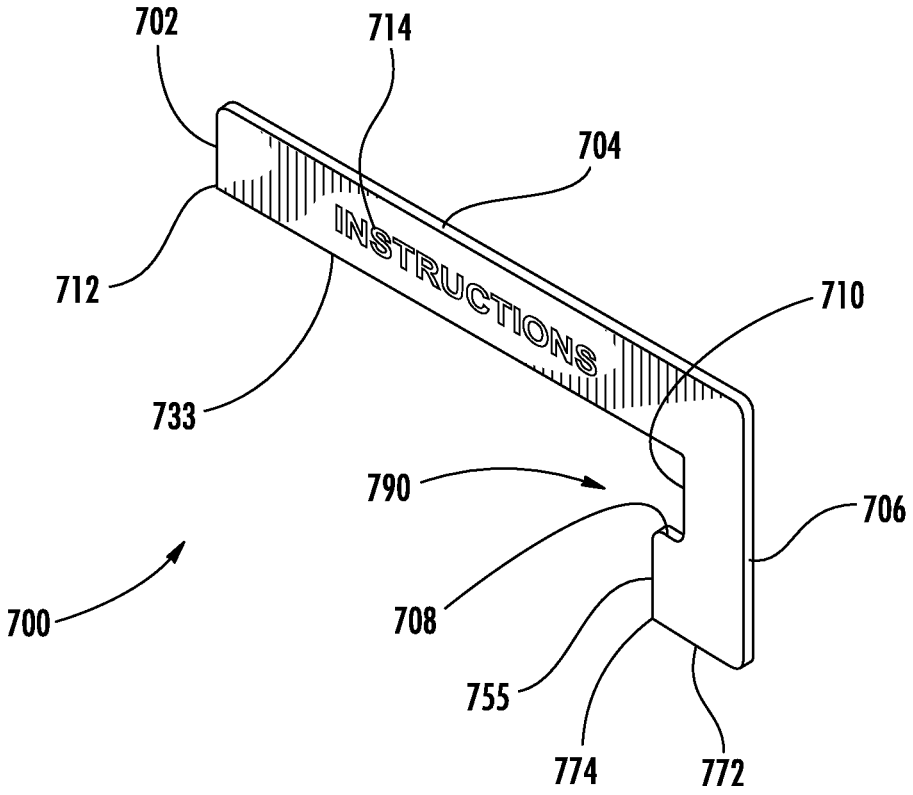
FIG. 9 is a perspective view of a template, shown according to another embodiment.

Referring to FIG. 9, a template 700 is shown according to an exemplary embodiment. Template 700 is configured to inform a user if sink 400 is compatible with (e.g., will appropriately fit) cabinet 200 and/or countertop 290. According to the exemplary embodiment, template 700 includes first through eighth surfaces shown as aft surface 702, top surface 704, front surface 706, bottom surface 772, rear surface 755, under-counter surface 708, bullnose surface 710, and countertop surface 733. Template 700 is shown to further include a first end, shown as aft end 712, and second end shown as bottom end 774. As shown, aft surface 702 extends upward from aft end 712. Surface 704 may extend forward from aft surface 702 to front surface 706. Front surface 706 may extend downward from top surface 704 to bottom surface 772. Bottom surface 772 may extend rearward from front surface 706 to bottom end 774.

Rear surface 755 may extend upward from bottom end 774 to under-counter surface 708. Under-counter surface 708 may extend forward from rear surface 755 to bullnose surface 710. Bullnose surface 710 may extend upward from under-counter surface 708 to countertop surface 733. Countertop surface 733 may extend rearward from bullnose surface 710 to aft end 712. According to an alternative embodiment, top surface 704 forms a curved surface extending from aft end 712 to bottom surface 772. In such an alternative embodiment, no discernable aft surface 702 or front surface 706 would be formed. As shown, countertop surface 733, bullnose surface 710, and under-counter surface 708 define a cutout (e.g., notch, recess, opening, etc.), shown as gap 704.

According to an exemplary embodiment, the distance from rear surface 755 to aft surface 702 is substantially equal to the distance rim 430 of sink 400 extends rearward from rear apron plane 492 of sink 400. According to another exemplary embodiment, the distance from rear surface 755 to aft surface 702 is substantially equal to the distance rim 430 extends rearward from front surface 209 of cabinet 200 when sink 400 is in an installed position. According to an exemplary embodiment, the distance in a rearward direction from bottom end 774 to aft end 712 is substantially equal to the distance rim 430 of sink 400 extends rearward from bottom end 474 of sink 400. According to the embodiment illustrated, the distance in a rearward direction from bottom end 774 to aft end 712 is substantially equal to the distance rim 430 of sink 400 extends rearward from a front face of a cabinet when sink 400 is in an installed position.

According to an exemplary embodiment, the distance from bottom surface 772 to countertop surface 773 is substantially equal to the distance from bottom end surface 472 of sink 400 to an underside of rim 430 of sink 400. According to another exemplary embodiment, the distance from bottom end 774 to countertop surface 773 is substantially equal to the distance from bottom end 474 of sink 400 to a bottom surface of rim 430 of sink 400. According to yet another exemplary embodiment, the distance from bottom end 774 to countertop surface 773 is substantially equal to the distance from the bottom extremity of apron 440 to a top surface of a countertop when sink 400 is in an installed position.

According to an exemplary embodiment, template 700 is configured such that countertop surface 733 may rest on a countertop (e.g., countertop 290) and rear surface 755 sits flush to a front surface of a cabinet (e.g. front surface 209). Gap 704 is configured to receive a front edge of the countertop. According to an exemplary embodiment, in use, rear surface 755 is placed against the front face of a cabinet, and template 700 indicates to a user if the countertop for proposed installation is deep enough to receive sink 400. According to another exemplary embodiment, in use, countertop surface 733 is placed against a top surface of countertop, and template indicates to a user if and how far apron 440 will extend below a bottom edge of drawer opening 214.

Instructions for the use of template 700, shown as instructions 714, may be printed on template 700. According to an exemplary embodiment, instructions 714 include a checklist indicating compatibility criteria. Elements of the checklist may be located on template 700 proximate to the location of interest. For example, a checkbox indicating that sink 400 will not hit a backsplash of countertop 290 may be located proximate aft end 712.

Use of template 700 according to an exemplary embodiment is described. Template 700 is placed on countertop 290 such that countertop surface 733 rests on countertop 290 and rear surface 755 is placed against front surface 209 of cabinet 200. The resulting location of aft end 712 will inform a user whether sink 400 will contact a backsplash on countertop 290 or whether rear rim 434 will cover a sink opening 297. Countertop surface 733 will inform a user whether countertop 290 is flat. For example, some countertops are contoured to contain spills. This contour would be indicated as a gap between countertop surface 733 and countertop 290. Bullnose surface 710 will inform a user whether a front edge of countertop 290 extends too far beyond front surface 209 as to interfere with apron 440. For example, if a front edge of countertop 290 contacts bullnose surface 710, the front edge of countertop 290 will contact right end portion 461 or left end portion 451 (e.g., front edge 457, first transition surface 458, and/or second transition surface 459). The resulting location of bottom end 774 will inform a user whether apron 440 will extend below drawer opening 214 or whether apron 440 will contact doors 210 or 212 located below sink 400 in cabinet 200.

Template 700 may be provided on any suitable material. According to an exemplary embodiment, template 700 is made from a rigid or semi-rigid material, for example, plastic or metal. According to another exemplary embodiment, template 700 is printed on a paper-based material (e.g., paper, cardboard, corrugated paper, etc.). According to the embodiment illustrated, template 700 is formed from corrugated fiberboard.

It is also important to note that the construction and arrangement of the elements of the sink as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the spirit of the appended claims.

What is claimed is:

1. A sink comprising:

a basin;

a rim extending about an upper portion of at least a portion of the basin; and an apron extending below the rim and having a first end portion and an opposite second end portion;

wherein the first and second end portions each comprise a front edge defining a lateral extremity of the apron, wherein the front edges of the first and second end portions are configured to at least partially overlap a front portion of a cabinet supporting the sink so as to conceal a cut line made in the front portion of the cabinet;

wherein each of the first and second end portions further comprise a rear edge extending from the front edge, wherein the rear edges define a rearward extremity of the apron; and wherein a lateral distance between the rear edges is less than a lateral distance between the front edges.

2. The sink of claim 1, wherein the rear edges are configured to be substantially parallel with and abut the front portion of the cabinet.

3. The sink of claim 1, wherein the first and second end portions each further comprise an end surface recessed laterally from the front edge.

4. The sink of claim 3, wherein the first and second end portions each further comprise a vertical lip, the vertical lip including a first transition surface extending from the front edge in a rearward direction and a second transition surface extending from the first transition surface toward the end surface.

5. The sink of claim 1, wherein the apron has a height that is less than a height of the basin.

6. The sink of claim 1, wherein the apron has a height that is substantially the same as a height of the basin.

7. The sink of claim 1, wherein the sink is a top mount sink.

8. A sink comprising:

a basin;

a rim extending about an upper portion of at least a portion of the basin; and an apron defining a front portion of the sink, the apron having a planar front surface extending vertically below the rim and laterally between a first end portion and an opposite second end portion;

wherein the first and second end portions each comprise a front edge defining a lateral extremity of the apron, wherein the front edges and the planar front surface cooperatively define a frontward extremity of the apron;

wherein the front edges define outermost extensions of the apron configured to at least partially overlap a front portion of a cabinet supporting the sink so as to conceal a cut line in the front portion of the cabinet;

wherein each of the first and second end portions further comprise a rear edge extending from the front edge, wherein the rear edges define a rearward extremity of the apron; and wherein a lateral distance between the rear edges is less than a lateral distance between the front edges.

9. The sink of claim 8, wherein the rear edges are configured to be substantially parallel with and abut the front portion of the cabinet.

10. The sink of claim 8, wherein the first and second end portions each further comprise an end surface recessed laterally from the front edge.

11. The sink of claim 10, wherein the first and second end portions each include a vertical lip, the vertical lip including a first transition surface extending from the front edge in a rearward direction and a second transition surface extending from the first transition surface toward the end surface.

12. A sink comprising:

a basin;

a rim extending from an upper portion of the basin; and an apron extending downward from the rim and having a planar front surface extending laterally between a first end and a second end;

wherein the first and second ends each comprise:

a front edge defining a lateral extremity of the apron, wherein the planar front surface and the front edges cooperatively define a frontward extremity of the apron; and a rear edge extending from the front edge, wherein the rear edges define a rearward extremity of the apron;

wherein the first end and the second end each define outermost extensions of the sink configured to at least partially overlap a front portion of a cabinet supporting the sink so as to conceal a cut line in the front portion of the cabinet; and wherein a lateral distance between the rear edges is less than a lateral distance between the front edges.

13. The sink of claim 12, wherein the rear edges are configured to be substantially parallel with and abut the front portion of the cabinet.

14. The sink of claim 12, wherein the first and second ends each further comprise an end surface recessed laterally from the front edge.

15. The sink of claim 14, wherein the first and second ends each further comprise a vertical lip, the vertical lip including a first transition surface extending from the front edge in a rearward direction and a second transition surface extending from the first transition surface toward the end surface.

* * * * *